US008579703B2

(12) United States Patent
Holch

(10) Patent No.: US 8,579,703 B2
(45) **Date of Patent: *Nov. 12, 2013**

(54) CASHLESS COMPUTERIZED VIDEO GAME SYSTEM AND METHOD

(75) Inventor: Niels C. Holch, Annapolis, MD (US)

(73) Assignee: Niels C. Holch, Annapolis, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/541,385

(22) Filed: Jul. 3, 2012

(65) Prior Publication Data

US 2013/0005433 A1 Jan. 3, 2013

Related U.S. Application Data

(63) Continuation of application No. 12/686,186, filed on Jan. 12, 2010, now Pat. No. 8,235,805, which is a continuation of application No. 10/320,482, filed on Dec. 17, 2002, now Pat. No. 7,695,366.

(60) Provisional application No. 60/339,779, filed on Dec. 17, 2001.

(51) Int. Cl.
*A63F 9/24* (2006.01)

(52) U.S. Cl.
USPC ..... 463/25

(58) Field of Classification Search
USPC ..... 463/25
See application file for complete search history.

(56) References Cited

U.S. PATENT DOCUMENTS

| | | | |
|---|---|---|---|
| 4,322,612 | A | 3/1982 | Lange |
| 4,494,197 | A | 1/1985 | Troy et al. |
| 5,179,517 | A | 1/1993 | Sarbin et al. |
| 5,275,400 | A | 1/1994 | Weingardt et al. |
| 5,470,079 | A | 11/1995 | LeStrange et al. |
| 5,476,259 | A | 12/1995 | Weingardt |
| 5,564,701 | A | 10/1996 | Dettor |
| 5,674,128 | A | 10/1997 | Holch et al. |
| 5,779,547 | A | 7/1998 | SoRelle et al. |
| 5,984,779 | A | 11/1999 | Bridgeman et al. |
| 6,577,733 | B1 | 6/2003 | Charrin |
| 6,634,946 | B1 | 10/2003 | Bridgeman et al. |
| 6,722,980 | B2 | 4/2004 | Stronach |
| 6,908,390 | B2 | 6/2005 | Nguyen et al. |

*Primary Examiner* — Masud Ahmed
(74) *Attorney, Agent, or Firm* — Marvin A Motsenbocker; Mots Law, PLLC

(57) ABSTRACT

A system and method for operating one or more games for a plurality of players including identifying at least two players participating in a selected one of the games at the expiration of a predetermined time period, and establishing a wager pool corresponding to a total of wager amounts from each of the identified players. The wager pool is reduced by a takeout amount. One or more random numbers are generated, and one or more winners of the selected game are determined based on the one or more random numbers. Funds are distributed from the wager pool to the determined one or more winners of the selected game.

44 Claims, 6 Drawing Sheets

CASHLESS COMPUTERIZED VIDEO GAME SYSTEM AND METHOD

CROSS-REFERENCE TO RELATED APPLICATION

This application is a continuation of U.S. patent application Ser. No. 12/686,186, filed Jan. 12, 2010, which is a continuation of U.S. patent application Ser. No. 10/320,482, filed Dec. 17, 2002, now U.S. Pat. No. 7,695,366, which claims priority from U.S. Provisional Patent Application No. 60/339,779, filed Dec. 17, 2001. The contents of these applications are incorporated herein by reference in their entirety.

FIELD OF THE INVENTION

The present invention relates generally to quick response production systems, and more particularly to a system and method for generating large volume productions of custom plush products.

BACKGROUND OF THE INVENTION

Gambling is a popular activity as reflected by the rapid increase in the number of casinos, as well as the increase in U.S. states that have casinos. These casinos deal with millions of dollars of transactions and generate equally substantial revenues. Casinos make their money by relying on the mathematical probability that a certain event or series of events will occur. For example, in the American version of the game of Roulette, there are 38 numbers that a player can bet on (1-36, 0, and 00). The correct mathematical odds of hitting one of these 38 numbers is 37-1. However, the casino will pay a winner only 35-1 odds, providing the casino (or the "house" as it is commonly referred to) with approximately a 5.26% advantage over the player.

This approach applies to other games, such as Craps, a popular and fast dice game. A bet on the "Pass" line pays 1-1 odds (even money); however, the true mathematical odds are slightly less than 50%, providing the house with approximately a 1.4% advantage over the player.

Casinos agree to pay players these fixed odds payouts, guaranteeing these payouts no matter how many players are playing these games and, more importantly, how many players are winning or losing at these games. This means that the casino is telling the player that a correct selection in Roulette will pay 35-1 odds, no matter what else is being bet on this Roulette table and irrespective of the performance of other players at the same table or other tables.

By making these guaranteed, fixed odds payouts, a casino is serving as the banker for the outcome of these games, thus the term "banked" games. The casino cannot predict the outcome of any one particular game, of course, but the actual results will statistically end up at their true mathematical odds over long periods of time, with thousands and thousands of transactions. The difference between these true mathematical odds and the actual results, with a built-in house advantage of a favorable fixed payout schedule, is how a casino derives a profit for these games.

A pari-mutuel betting system works a little differently. Invented in the $19^{th}$ century in France, this betting system requires the separation of the amounts which are wagered by the participating players into: (1) a predetermined payment representing the gaming operator's profit, and (2) a player winnings pool, which represents the balance of the amounts wagered by the participating players after the gaming operator is paid. In a pari-mutuel system, players usually make wagers on a particular game of chance, event, or series of events. The two most common examples of pari-mutuel betting can be found at a table Poker game or at a thoroughbred horse race. In both cases, the gaming operator or house establishes a player wagering pool dedicated only to that particular game of chance, event, or series of events. The house then takes a slice of money off the top of the player pool, called a "takeout." This takeout amount is, in essence, a commission to the gaming operator for sponsoring the event(s) or game. The typical commission percentage for table Poker is usually no more than 5% of the player pool for each hand or for each game. In a thoroughbred horse race, the typical takeout or commission is 10-15% of the total player pool dedicated to that race.

In a pari-mutuel betting format, players are competing with each other for winnings from a game of chance, event, or series of events and the gaming operator has no stake in the outcome of the game of chance or the event(s). As soon as the commission or takeout is removed from the player pool, the gaming operator is completely indifferent to the outcome of the game or event(s). Unlike the fixed odds payout system described earlier, the pari-mutuel pool is shared exclusively with the winning players and the house has no risk of a monetary loss due to the short-term volatility of the game or event(s). In reality, over long periods of time, these two betting systems provide very similar financial results, from the perspective of the gaming operator. But in the short-term, and in the actual mechanics of each betting system, the two are very different.

Casinos generally use the "banked" system referred to previously for their table games and slot machines. In this way, a player is competing for winnings against the gaming operator directly, using the fixed odds payout method described above. The game of Poker is a clear exception, as it can be played at a casino table in a pari-mutuel format. On a video machine, however, poker is played in a banked format as the player is only playing against the fixed odds of the banked system, and not against other players. Decisions by any player do not impact in any way the decisions of other players playing the same game.

Most table games and slot machines in a traditional casino operate on a pay-as-you go, cash basis (i.e., through the use of coins and currency), with players participating in games of chance and event(s) in a manner which is independent of the actions of other players. When a casino or gaming operator relies on this type of fixed odds payout system, it is difficult to organize games of chance and event(s) in a manner which allows the creation of pari-mutuel player winnings pools and the ability of players to compete against each other for winnings.

Computer technology has advanced to the point where it is now possible to create a "cashless" gaming environment, in which players can participate in games of chance and event(s) using pre-established wagering accounts located on a network consisting of central computers and linked player terminals. This computer network system is capable of creating player winnings pools, subtracting a takeout or commission for the gaming operator, and distributing the remaining balance of funds to winning players in a classic pari-mutuel format. Among other benefits, such a pari-mutuel gaming system and method could permit players to participate in a new and different gaming environment, while at the same time reducing the short-term volatility of the revenues and profits of a gaming operator, at least when compared to a traditional fixed odds payout system.

It therefore would be desirable to have a computer network which is capable of operating casino games in a pari-mutuel format.

SUMMARY OF THE INVENTION

Briefly, in one aspect of the present invention, a system and method for operating one or more games for a plurality of players including identifying at least two players participating in a selected one of the games at the expiration of a predetermined time period, and establishing a wager pool corresponding to a total of wager amounts from each of the identified players. The wager pool is reduced by a takeout amount. One or more random numbers are generated, and one or more winners of the selected game are determined based on the one or more random numbers. Funds are distributed from the wager pool to the determined one or more winners of the selected game.

BRIEF DESCRIPTION OF THE DRAWINGS

The accompanying drawings, which are incorporated in and constitute a part of the specification, illustrate presently preferred implementations of the invention. Together with the general description given above and the detailed description of the preferred embodiments given below, the drawings explain the principles of the invention.

In the drawings.

DETAILED DESCRIPTION OF THE PREFERRED EMBODIMENT

Reference will now be made in detail to the construction and operation of preferred implementations of the present invention illustrated in the accompanying drawings. In those drawings, like elements and operations are designated with the same reference numbers when possible.

The following description of the preferred implementations of the present invention are only examples of the invention. The present invention is not limited to these implementations, but may be realized by other implementations.

Figure 1:
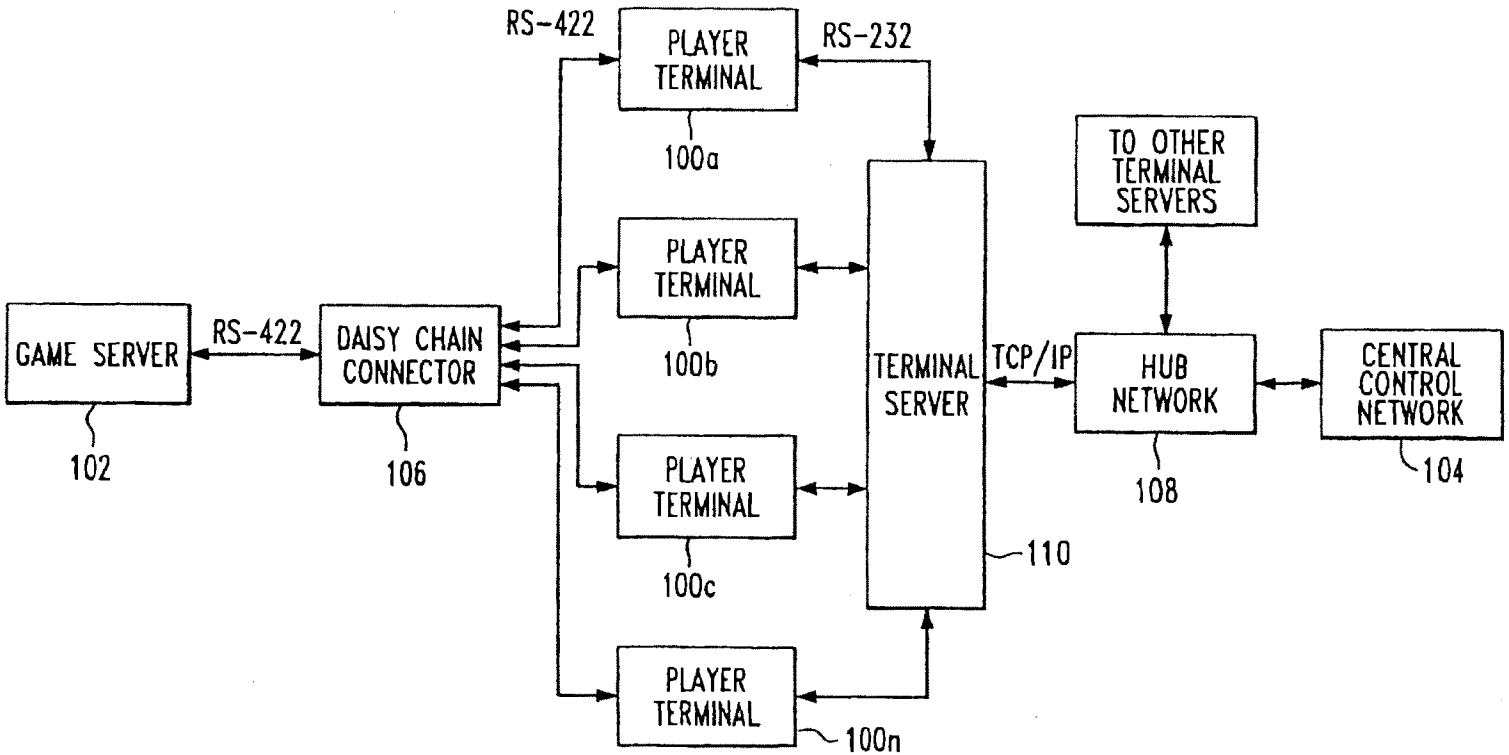
FIG. 1 is a block diagram of a system for operating several electronic games for a plurality of players in accordance with one embodiment of the present invention.

FIG. 1 shows a block diagram of a cashless video game system in accordance with a preferred embodiment of the present invention. As shown, the system generally comprises a plurality of player terminals 100*a*-100*n*, a game server 102 connected to each of the player terminals 100*a*-100*n*, and a central control network 104 connected to each player terminal for administering and controlling the player terminals 100 and for maintaining player accounts. Game server 102 preferably connects to the player terminals 100 via a daisy-chain connection 106 and communicates via the RS-422 protocol. The central control network 104 connects to each player terminal 100 via a hub network 108 and a terminal server 110.

In a preferred embodiment, the system also includes a terminal server 110 connected to each player terminal 100 and communicates via the RS-232 protocol. Terminal server 110 converts information from the player terminals 100 to the TCP-IP protocol and communicates the converted messages to the central control network 104 via the hub network 108. Hub network 108 preferably comprises an Ethernet network.

As shown in FIG. 1, a group of player terminals 100*a*-100*n* are serviced by a single game server 102 and a single terminal server 110. In a preferred embodiment, a single game server 102 and single terminal server 110 service up as many as thirty-two player terminals. Additional groups of player terminals (not shown) are connected to the central control network 104 via the hub network 108. As with the group of player terminals 100*a*-100*n*, any additional groups of player terminals are also preferably serviced by a single game server and are connected to the hub network via a single terminal server. Thus, in accordance with the present invention, a gaming system may comprise hundreds or thousands of player terminals. A single game server and a single terminal server service a group of player terminals, and central control network 104 controls all the groups of player terminals.

Figure 2:
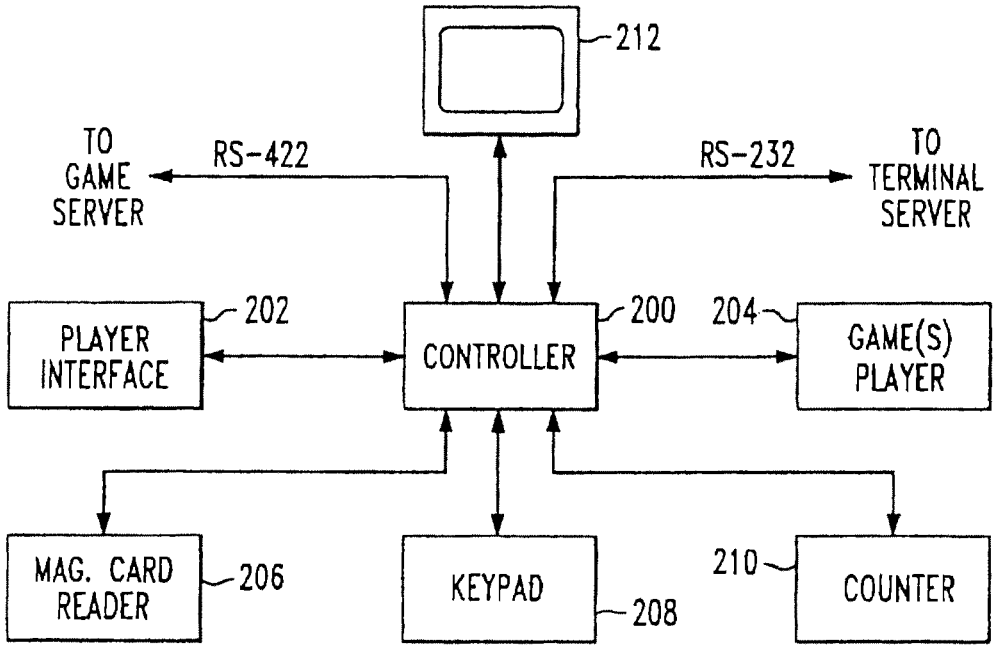
FIG. 2 is a block diagram of a player terminal in accordance with one embodiment of the present invention.

FIG. 2 illustrates a block diagram of a player terminal 100 in accordance with one embodiment of the present invention. Player terminals 100 differ from conventional electronic slot machine-type video game terminals because they do not receive coins or currency and do not pay off winners with coins or currency. Rather, in accordance with a preferred embodiment of the present invention, player terminals 100 accept a magnetic card, smart card, or key (referred to generically as magnetic card), and communicate with the central control network 104 to debit and credit a player's account based on amounts wagered by the player for each game.

Referring to FIG. 2, player terminal 100 comprises a controller 200, player interface 202, game player 204, magnetic card reader 206, keypad 208, counter 210, and video display 212. Player interface 202 preferably comprises a software application for displaying video graphics to attract a player to the player terminal. Game player 204 preferably comprises software applications running electronic games of chance, such as poker, blackjack, pulltabs, lotto, keno, or bingo. These games are preferably conventional video games of chance except that, as described below, they receive a random number from the external game server 102 and base a win/lose result on that random number and the player's selection(s). In accordance with the invention, each player terminal 100 plays any one of several games independently of the others. Thus, within a group of player terminals such as player terminals 100*a*-100*n*, several players may be playing poker while others play keno and still others play bingo. Regardless of the game, the player terminals 100 determine a result of the game based on the random number from the game server 102.

Magnetic card reader 206 preferably comprises a conventional magnetic card reader capable of reading a credit card—or smart card-type player identification card. The type of card will dictate the type of card reader.

Keypad 208 preferably comprises a conventional alphanumeric or numeric key entry device. Keypad 208 permits a player to enter a personal identification number ("PIN") to verify the player at the player terminal 100.

Video display 212 preferably comprises a conventional touch screen video monitor for displaying video graphics and receiving player inputs. A touch screen is not necessary, however, since player inputs can be made through keypad 208.

The counter 210 preferably comprises a conventional digital counting device for counting a predetermined interval between game plays. The counter 210 helps synchronize operation.

As described above, electronic games of chance rely on randomly generated numbers to determine wins and losses. Although the video games are preferably played by game player 204 at the player terminals, the random number from which the games player 204 determines wins and loses at each player terminal is generated by the game server 102 servicing those player terminals 100.

Figure 3:
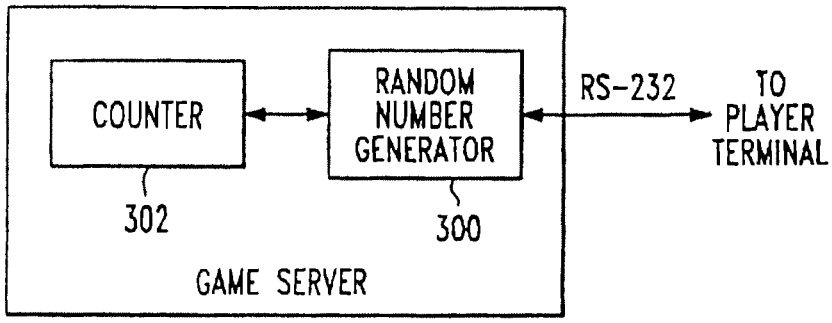
FIG. 3 is a block diagram of a game server in accordance with one embodiment of the present invention.

Thus, as shown in FIG. 3, game server 102 preferably comprises a random number generator 300 and a counter 302. Game server 102 preferably generates random numbers once during a predetermined period, e.g., every few seconds, as determined by counter 302. During a given predetermined period, if a player at player terminal 100 enters a wager and presses the "Play" button, the player must await the display of the next set of winning numbers. In the meantime, as soon as the "Play" button is selected, player terminal 100 notifies game server 102 and game server 102 enrolls that player terminal 100 in the next game.

Upon expiration of the predetermined period, game server 102 generates one or more random numbers for each type of game offered at player terminals 100 that it services. Game server 102 then sends the random numbers corresponding to the selected game at enrolled player terminal 100. Player terminal 100 receives the corresponding random numbers and determines the win or loss of that game.

Each number in the generated set of random numbers may represent the winning number. For example, if keno is selected at player terminal 100 that is enrolled for the next game, game server 102 generates a set of twenty winning numbers. If the result of the game depends on a graphical figure, for example, Lucky Gem where three consecutive diamonds result in a winning jackpot, a predetermined number represents a certain shape of gem. Random numbers can also be translated into colors and other symbols, including playing cards. To ensure proper randomization, however, game server 102 randomly or periodically changes the number corresponding to a certain graphical figure, color or symbol.

In another embodiment consistent with the present invention, game server 102 may generate a single set of random numbers and transmit them to player terminals 100. Player terminals 100 would then convert the single set of random numbers to game-specific numbers, colors or symbols corresponding to the selected game at that terminal. This simplifies the tasks at game server 102 by generating only a single set of random numbers regardless of what games are selected at player terminals 100. Additionally, this embodiment alleviates the need for game server 102 to maintain enrollment information of player terminals 100. Player terminals 100 would, however, need to perform additional computation in converting the set of random numbers to game-specific numbers. In any event, the centralization of the random number generation provides an efficient and effective means for controlling the games, increases the average number of games played, and helps reduce fraud.

Because of the predetermined interval between generations of random numbers, a player who makes a "play" during that interval, must wait until that interval expires before the player terminal 100 receives the random number and determines a win or loss for that "play." The interval can, of course, be selected to be any predetermined interval to accommodate players and a provider of the system and games.

Figure 4:
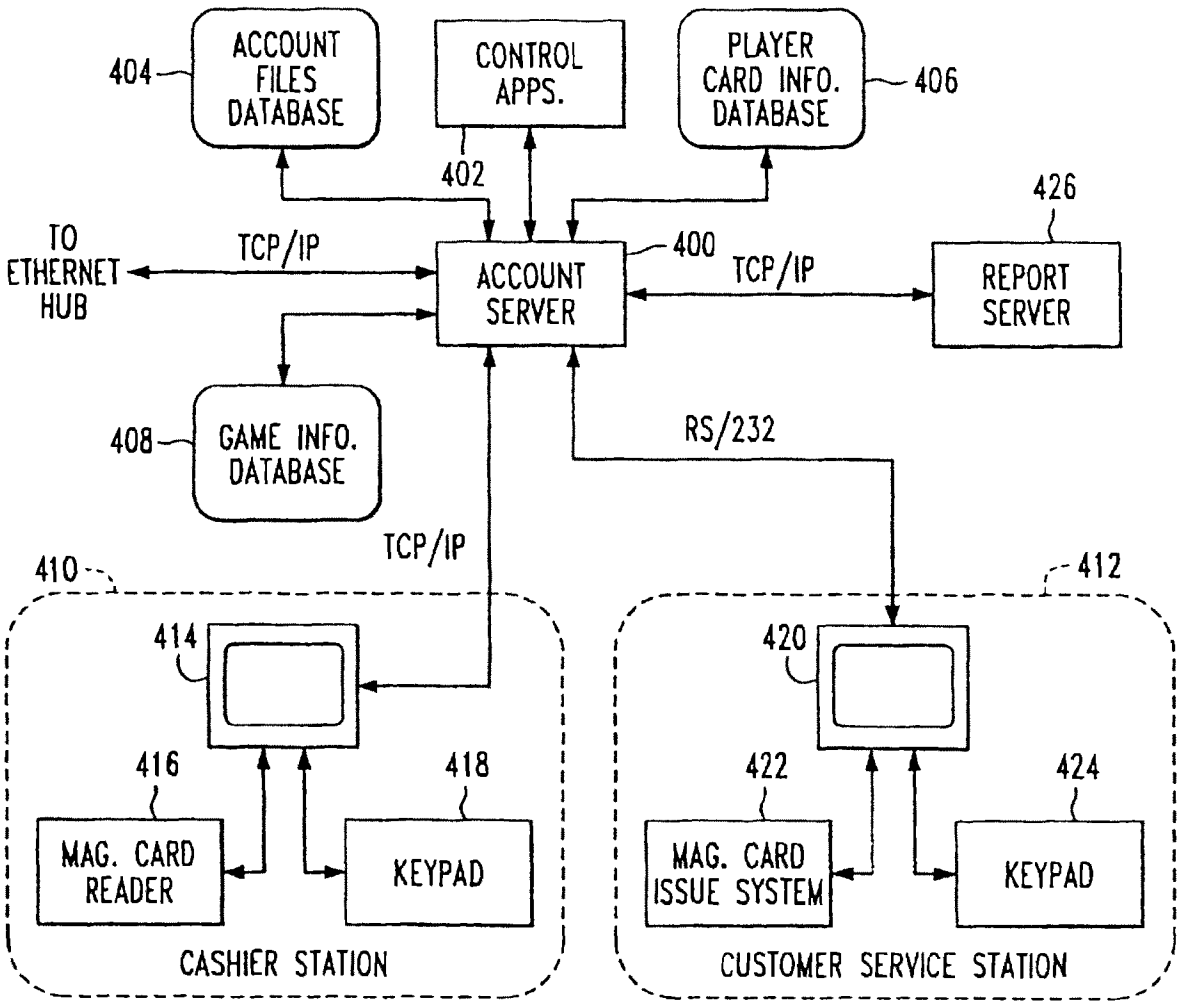
FIG. 4 is a block diagram of a central control network in accordance with one embodiment of the present invention.

In accordance with the present invention, central controller network 104 provides a centralized control means for monitoring and administering all video games and player accounts. Central controller network 104 tracks each player activity, preferably on a real-time, per-game basis, to maintain current and comprehensive information about the players at any time during the player's session at player terminals 100. FIG. 4 provides a block diagram of the central control network 104 in accordance with a preferred embodiment of the invention.

Central control network 104 preferably comprises an account server 400 running control applications 402 to provide the administrative and service functions described in this application. Account server 400 stores players' account information in an account files database 404, stores player card information in a player card information database 406, and stores game result information in a game information database 408. In addition, account server 400 preferably controls a cashier station 410 and a customer service station 412.

Cashier station 410 preferably comprises an operator terminal 414, connected to the account server via an Ethernet connection, a magnetic card reader 416, and a keypad 418. Customer service station 412 preferably comprises an operator terminal 420, connected to account server 400 via an RS-232 connection, a magnetic card issue system 422, and a keypad 424. Magnetic card reader 416 and issue system 422 preferably comprise conventional devices for reading and generating credit card-type magnetic cards. Likewise, keypads 418 and 424 preferably comprise conventional alphanumeric or numeric keypads, and terminals 414 and 420 preferably comprise conventional PC or networked data entry terminals.

Although the account server 400 is shown as a single element of the central control to network 104, in a preferred embodiment account server 400 comprises fault-tolerant, paired computers.

In addition to administering games and customer accounts, central control network 104 also provides reports on both using a report server 426. Account server 400 preferably trickles information from its transaction log file in its databases 404, 406, and 408 to the report server 426, which in turn generates customized or standardized reports in accordance with a service providers' requirements. Report server 426 may comprise, for example, an IBM RS-6000 computer and/or an IBM A/S 400 computer. Each entry of the transaction log file preferably contains header information such as message type, transmission number, transaction code, and player account number to identify the type of message and transaction.

The transfer of information from account server 400 to report server 426 preferably occurs in real-time. Although only one physical connection may exist between account server 400 and report server 426, account server 400 may transfer the information in multiple logical units in parallel. This approach is desirable during peak times when transaction volume is high.

At service station 412, a player wishing to use a player terminal 100 can establish an account and receive a magnetic I.D. card to operate the player terminal 100. Preferably, a player provides an operator with some identifying information, and the operator uses terminal 420 to transmit this information to account server 400. Account server 400 establishes an account file for the player in account files database 404 and assigns a corresponding account number to that player. In addition, the operator may ask the customer to select a PIN via keypad 424. The player identifier information, the account number, and an encrypted version of the PIN is then stored on a magnetic strip on a magnetic I.D. card issued by the magnetic card issue system 422. Although not shown, customer service station 412 may also include a scanning device for scanning and storing a player's signature or photograph. Likewise, customer service station 412 may include a camera for photographing the player and including a picture on the player's I.D. card. Account server 400 stores the player's identification information in the player card information database 406. Such information may include the player's name, address, gender, birthday, and phone number. Any scanned information may be stored in a separate file server. Finally, the customer server status 412 may include a printer device to print, for example, customer receipts.

After receiving an I.D. card, the player proceeds to a cashier station 410 to deposit money into his or her account. An operator swipes the card through the magnetic card reader 416 to credit the account via the keypad 418 after receiving payment from the player. Account server 400 stores the player's account information in the account files database 404, preferably including the time, date, and amount of deposit as well as the resulting account balance.

Cashier station 410 also serves to pay players having positive account balances at the end of their play sessions. To receive money, a player provides an operator at cashier station 410 with his/her I.D. card. The operator swipes the I.D. card to retrieve the account balance information, verifies the player by requesting the player to input his/her PIN via keypad 418, and pays the player any positive account balance. Additional player verification measures may be required for security reasons. Account server 400 stores the player's account information in the account files database 404, preferably including the time, date, and amount of withdrawal as well as the resulting account balance. Although shown as two separate stations, cashier station 410 and customer service station 414 may be combined as a single customer service/cashier station.

To help illustrate the operation of the cashless video game system of the present invention, a preferred method of operation and system process will now be explained with reference to the system elements in block diagrams in FIGS. 1-4 and the process flow diagram shown in FIGS. 5*a* and 5*b*.

Figure 5A:
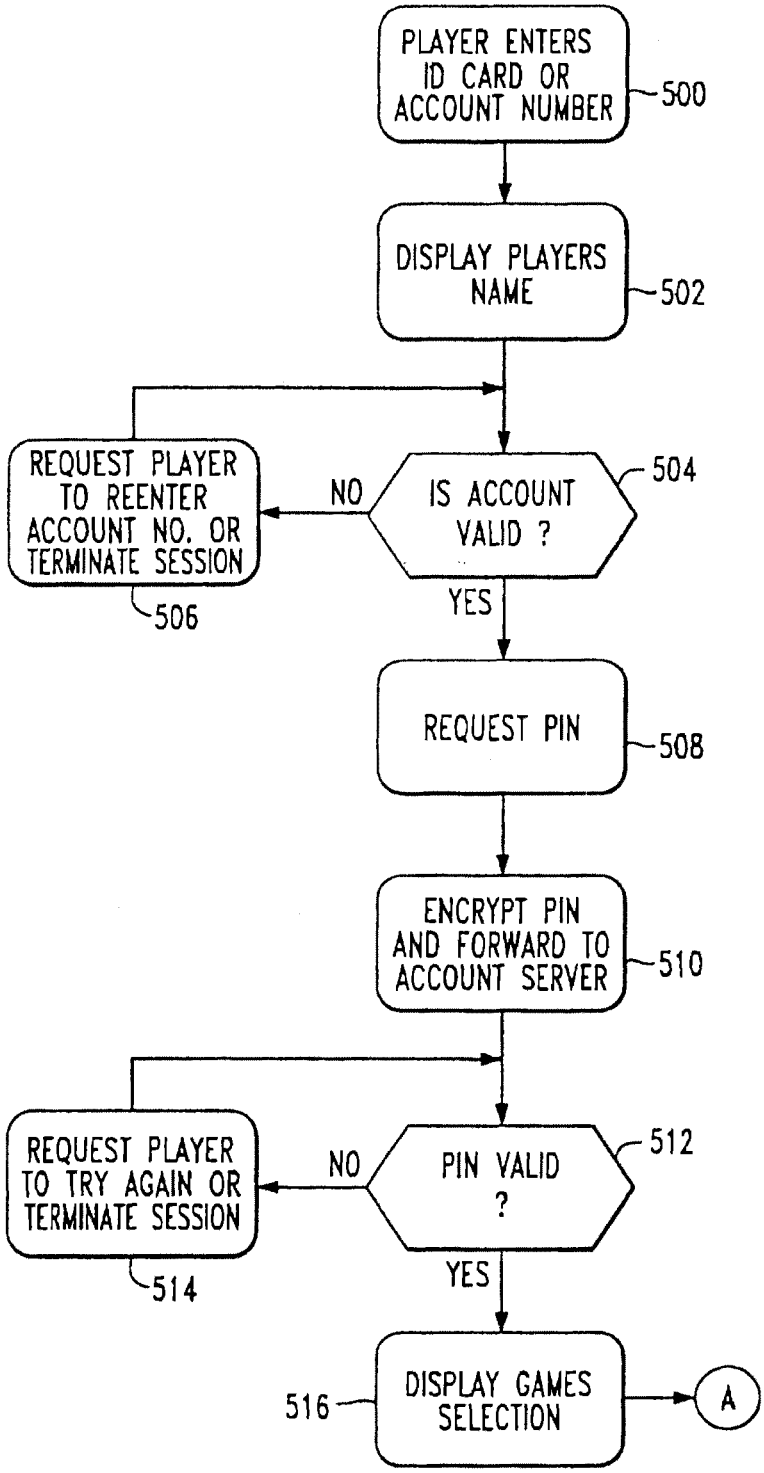
FIGS. 5*a* and 5*b* are process flow diagrams illustrating a method of operating a video game system in accordance with one embodiment of the present invention.
Figure 5B:
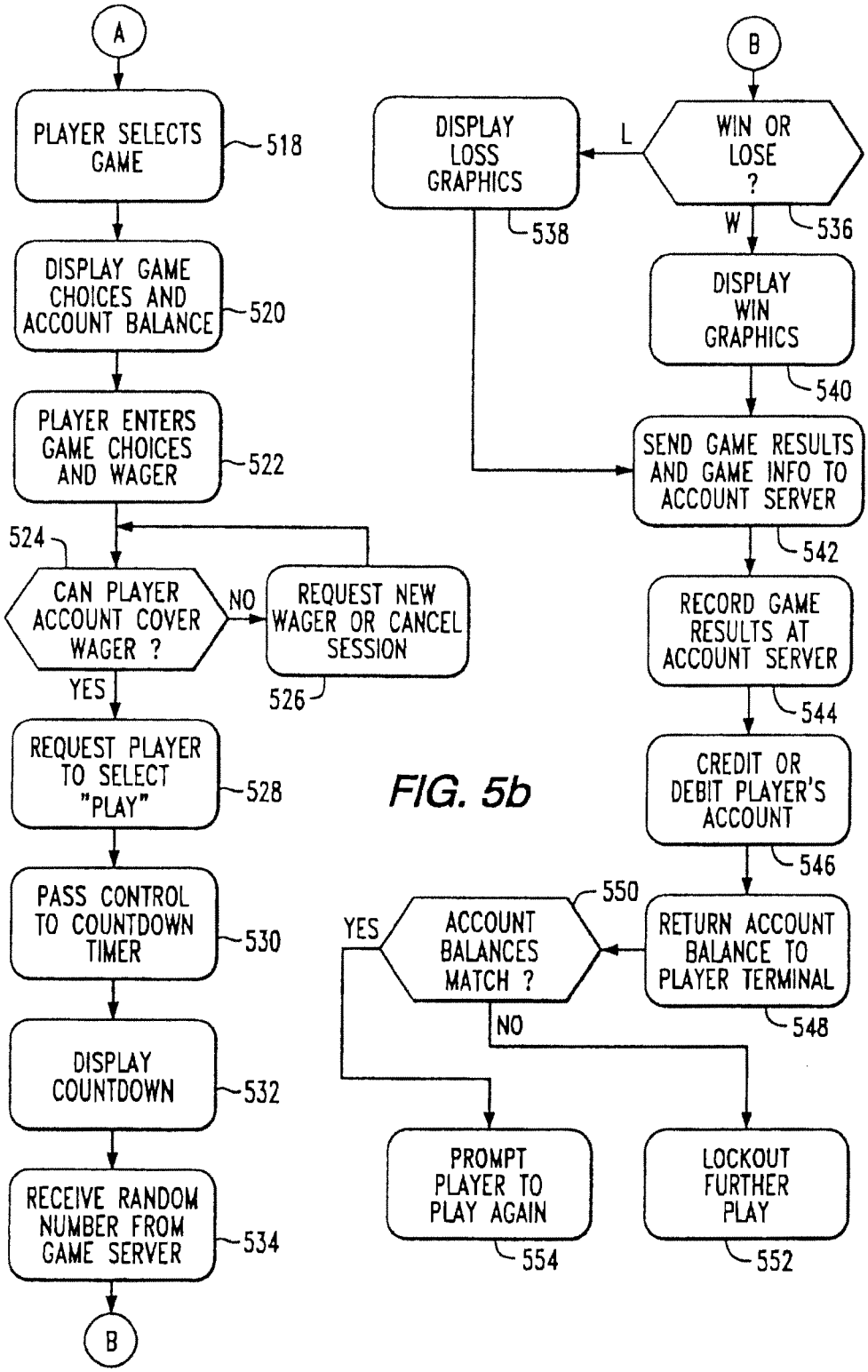

Referring to FIG. 5*a*, after opening a player account and obtaining a player I.D. card, a player logs onto a player terminal 100 by inserting the I.D. card into the magnetic card reader 206 (step 500). Alternatively, the system does not require player I.D. cards, so the player simply enters his/her assigned player account number using keypad 208.

The player terminal 100, which has been executing attract mode video graphics, reads the information from the I.D. card, displays the player's name (step 502) sends the player account number to the account server 400, and requests the account server 400 to verify the player's account number. Account server 400 receives the account number and, referring to the account file database 404, determines whether the player account number is valid (step 504). If not, player terminal 100 informs the player and either requests the player to reenter the account number or terminates the session (step 506).

If account server 400 determines that the account number is valid, player terminal 100 requests the player to enter his/her PIN (step 508). Player terminal 100 preferably encrypts the PIN and forwards the encrypted PIN to the account server 400 (step 510). Account server 400 receives the PIN and determines whether the PIN is valid and corresponds to the player's account number (step 512). If the PIN is not valid or does not correspond to the player's account number, player terminal 100 either requests that the player reenter the PIN, or terminates the session (step 514). If the PIN is valid, player terminal 100 displays a graphical selection of video games on video display 212 (step 516). As described, the video games may include poker, blackjack, pulltabs, lotto, keno, or bingo.

Using the touch screen video display 212 or keypad 208, the player then selects a desired game (step 518). The player terminal 100 displays the corresponding game graphics and requests the player to enter game choices corresponding to that game (step 520). For a particular game, a player may have to make certain selections required by the rules of each game including a selection of predetermined numbers, colors, and/or symbols. For example, if the player selects keno, video display 212 may display eighty numbers from which the player selects up to twenty numbers via the video display screen 212. Player terminal 100 also displays the account balance during a player session.

The player then enters his/her game choices and a wager amount (step 522). In a preferred embodiment, video display 212 also displays the wager amount during each game. Player terminal 100 responds to the waged amount by requesting the account server 400 to verify that the player has a sufficient balance in his/her account to cover the wager.

When the account server 400 receives this request from the player terminals it makes the requested determination (step 524). If the player has insufficient funds to cover the wager, the player terminal 100 so informs the player and either requests the player to enter a new wager consistent with the player's account balance or terminates the session (step 526). If account server 100 determines that the account balance is sufficient to cover the wager, player terminal 400 informs the player that he/she is authorized to play and requests the player to select a "play" button on the video display 212 or keypad 208 (step 528). Once the player selects the "play" button, player terminal 100 passes control to counter 210 (step 530) and waits to receive one or more random numbers from the corresponding game server 102.

Again, as explained above, because game server 102 is generating a random number, or a series of random numbers, at a predefined interval, the player who has selected the "play" button during the interval must wait until the player terminal 100 receives the random number(s) to determine the results of the play. Counter 210 in player terminal 100 keeps track of this interval and, in one embodiment, may display the time remaining between the player's selection of the "play" button and the determination of a win or loss (step 532).

As explained above, at the end of the interval, game server 102 generates one or more random numbers corresponding to each of the plurality of games at player terminals 100. Game server 102 transmits to each corresponding player terminal 100 the random numbers corresponding to the game being played at player terminal 100. Player terminal 100 receives the random number or numbers from the game server 102 (step 534) and determines whether the player has won or lost that game (step 536). If the player has lost, player terminal 100 displays preselected loss graphics explaining the losing results (step 538). If the player wins, player terminal 100 displays preselected win graphics explaining the winning results (step 540). As explained above, the random number(s) generated by game server 102 may be translated into colors or symbols, including playing cards, at player terminal 100.

Win or lose, player terminal 100 sends the game result and game information to account server 400 (step 542). Such information may include, for example, the player terminal number, game type code, game number, time, date, wager amount, and resulting account balance. In accordance with certain requirements, some or all of this information may be encrypted in accordance with conventional encrypting techniques. As described below, player terminal 100 also maintains the player's account balance during a player session.

The account server 400 responds to the data from the player terminal 100 by recording the game information in the game information database 408 (step 544) and crediting or debiting the player's account the waged amount (step 546). Account server 400 then preferably returns the updated account balance to the player terminal 100 (step 548). Player terminal 100 determines whether the returned account balance matches the account balance being tracked by the player terminal 100 (step 550). This additional monitoring of the player's account balance helps protect the game service provider and the player by reducing fraud and detecting balance inconsistencies as early as possible, ideally on a real-time, per-game basis. If the account balances do not match, the player terminal 100 may prevent the player from continuing, and request service assistance (step 552). If the account balances match, player terminal 100 preferably prompts the player to choose whether to play again (step 554).

When a player has finished playing, he/she exits the player terminal using an appropriate touch screen command on video display 212 or key on the keypad 208 and returns to the cashier station 410 to settle his/her account. As described, using cashier terminal 414, a cashier (not shown) requests the player account information from the account server 400 and redeems the balance of the player's account to the player.

In the preferred embodiment consistent with the present invention, player terminals 100 transmit real-time to account server 400 all player activity information input by the player. This information may include, for example, the player's account number, information on the game played, and the game choices selected by the player, the wager amount, the winning numbers provided by the game server 102, and a credit or debit request for crediting or debiting the player's account the wager amount. Account server 400 stores player activity information at account files database 404 and player card information database 406. The player card information includes player demographics data such as age, gender, and geographic location. Accordingly, central controller network 104 maintains a current and comprehensive player activity information and demographics of each player, which may be accessed at any time by authorized personnel.

Report server 426 may provide a report of varying specificity including a detailed listing of an individual player's activity for a specified time period, a summary of a player's activity over a period of time, actual number of games played by each player, and a summary of all players' activity on a particular day or over a period of time. Report server 426 generates these reports periodically, for example, once every two minutes. Server 426 may then generate a player activity report outlining player gambling habits such as frequency of plays, favorite games, nomination of player terminals, and average amount of wagers. Such a player tracking report is valuable to casinos and players. Based on such reports, for example, casinos may tailor the types, number, and wager amount of games offered at player terminals 100 to accommodate player demand. Player terminals 100 may be modified periodically or interactively based on current player demand.

Additionally, casinos may use the reports as a tool to identify players with certain characteristics for marketing purposes. One marketing tool may be to offer "free play" cards, which are unique player cards with non-redeemable, playable credits. Such cards may be used as an incentive to attract players to the casino. Casinos may also offer complimentary "free play" cards to players who spend a certain amount of time playing games. Player's account number along with expiration date and time of the free play cards may be printed on the card. Upon expiration such date and time, player terminals 100 will not recognize the free play card. Additionally, casinos may program cashier stations 410 to restrict withdrawals on the free play cards to only amounts greater than the face value of the card. The redemption period may also be restricted, for example, as a predetermined number of days after the expiration date.

Central tracking of all player activity on a per-game basis helps better tailor player terminals 100 based on player use and demand, reduce fraud, and target marketing efforts to players with certain attributes. Additionally, instantaneous information provides greater flexibility for managing gaming establishments. For example, such information may enable gaming establishment to access information whether player habits qualify for special awards during the play. It also helps detect fraud while it is occurring, for example, by detecting wins that far exceed average statistical odds or a single player playing at multiple player terminals 100 simultaneously. Moreover, real-time maintenance of player activity enables accurate system recovery in emergency situations such as a power outage.

In the above description, players using the cashless video game system of FIG. 1 are not playing against each other, but rather are playing games individually against the computer. In this arrangement, casinos agree to pay players fixed odds payouts for games they win and guarantee these payouts no matter how many players are playing the games or how many players are winning or losing games. By making these guaranteed, fixed odds payouts, a casino is serving as the banker for the outcome of these games, thus the term "banked" games.

In addition to running the above described cashless video game system using banked games, it is possible to adapt the cashless video game system of FIG. 1 to allow for players to play directly against each other. In this arrangement, casinos do not serve as the banker for the outcome of the games. Rather, payouts are provided from a pool of the players' wagers. The casino derives its profit by taking a predetermined portion of the player's wagers, referred to as a takeout, from each pool. By relying on the pool of the players' wagers to fund the payouts from each game, the cashless video game system can be run in a pari-mutuel format, where the odds and payouts need not be fixed.

A cashless video game system to run games with players playing against each other can be implemented with substantially the same the system as described above with respect to FIGS. 1-4. Accordingly, a description of that implementation will not be repeated below. The adaptation to inter-player games, including games with a pari-mutuel format, alters the processing of how each game is run and how payouts are made.

To help illustrate the operation of the cashless video game system for inter-player games consistent with the present invention, a method of operation and system process will now be explained with reference to the system elements in block diagrams in FIGS. 1-4 and the process flow diagram shown in FIG. 6.

The initial operation is similar to the operation of the cashless video game system discussed above with reference to FIG. 5*a*. In particular, after opening a player account and obtaining a player I.D. card, a player logs onto a player terminal 100 by inserting the I.D. card into the magnetic card reader 206 or simply enters his/her assigned player account number using keypad 208. The player terminal 100 sends the player account number to the account server 400, which determines whether the player account number is valid. If valid, the player enters his/her PIN, and the account server 400 determines whether the PIN is valid and corresponds to the player's account number.

Figure 6:
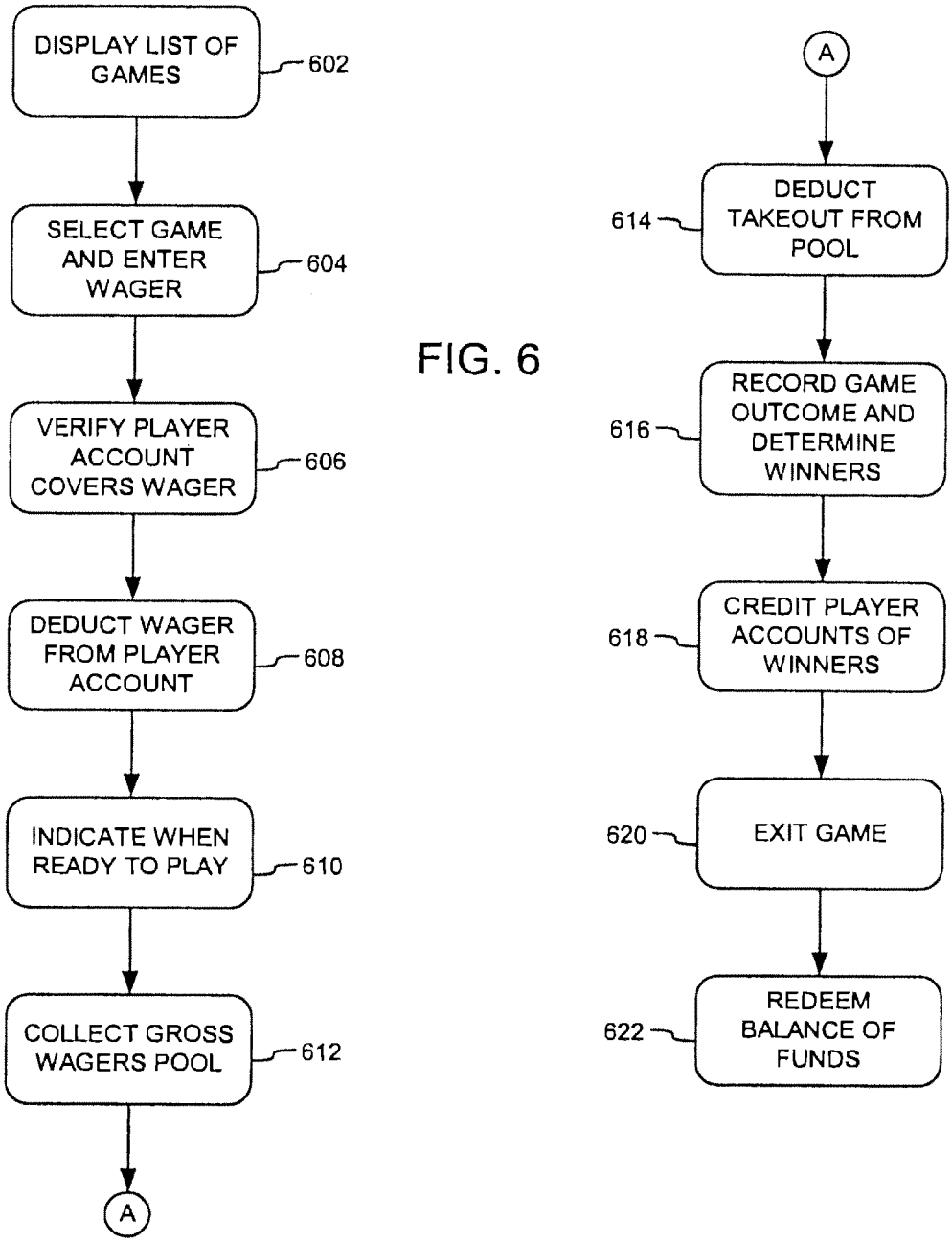
FIG. 6 is a process flow diagram illustrating a method of operating a video game system in accordance with another embodiment of the present invention.

With reference to FIG. 6, if the PIN is valid, player terminal 100 displays a graphical selection of video games on video display 212 (step 602). The video games may include, for example, poker, blackjack, pulltabs, lotto, keno, bingo, as well as other casino games played in a pari-mutuel format. It should be understood that the player terminal 100 can also offer the games to be played an inter-player arrangement or in a format where the player plays individually against the computer, as described above. If the player terminal 100 displays more than one game choice, the player selects which game he or she wishes to play and enters the amount of his or her wager (step 604).

The account server 400 verifies that the player has sufficient funds in his or her deposit/winnings account for the amount of the wager (step 606). The amount of the wager permitted by the player may be restricted based on the specific rules for the particular game being played. For example, if the rules of the game call for one winner to receive all of the proceeds of the player winnings pool, described below, the game may require a uniform wager amount for each player participating in that game.

After the wager has been recorded, the account server 400 deducts the amount of the wager from the player's account (step 608). The video display 212 on the player terminal 100 can display the amount wagered and the funds remaining in the deposit/winnings account.

All of the inter-player games offered at each player terminal 100 are played automatically, according to pre-established time sequences, regardless of whether or not wagers have been made by any player. Since all games operate continuously, players do not activate any of the offered games from any of the player terminals 100.

After a wager has been recorded, the player presses a button or a touch-screen command on the video display 212 to indicate when he or she is ready to enter the next game offered at the player terminal 100 (step 610). Before each game begins, and, in some cases, during the play of an individual game, the player also may be asked to make certain selections or decisions required by the rules of each game.

As players decide to enter the next game offered, the central controller network 104 creates a collective, pari-mutuel pool of all wagers that have been recorded for that game (step 612). This pari-mutuel pool is called the gross wagers pool. The gross wagers pool is closed as soon as a particular game begins.

At regular intervals, game server 102 randomly generates a pre-determined amount of numbers, symbols, and/or colors, as required by the rules of each game. The numbers, symbols and/or colors chosen by game server 102 are simultaneously displayed on the video display 212 of each player terminal 100 participating in a particular game.

As each game begins and is being played, the central controller network 104 deducts an amount from the gross wagers pool (step 614). This deducted amount is referred to as the takeout amount. The takeout amount can be calculated, for example, as a certain percentage or some predetermined amount of the gross wagers pool. The balance remaining after deducting the takeout amount from the gross wagers pool is called the player winnings pool.

After each game has been played, the account server 400 records the outcome of the game and determines individual player winnings (step 616). There may be one winner of the player winnings pool or multiple winners, depending on the rules for each game. For games with multiple winners, the player winnings pool is allocated using a pari-mutuel format, in proportion to the amount(s) wagered on the game played and following the rules for each respective game.

There are many ways in which the player winnings pool can be allocated using a pari-mutuel format. For example, the account server 400 can identify a predetermined number of top players, such as five, for the completed game and divide the player winnings pool among the top players in proportion to the amounts wagered. For card games, portions of the player winnings pool can be divided into separate portions assigned to particular types of hands, such as full houses and flushes in poker. A portion of each player winnings pool can also be allocated to a special big winner pool that is won by a player after an exceptional or unique result playing a game, such as a royal flush in poker or picking an extraordinary number of correct numbers in keno. Winning the big winner pool can be reserved to players that elect to have a portion of their wager go to the big winner pool, such as in a progressive wagering system. Other payout schemes from the player winnings pool are also possible.

The account server 400 then distributes the entire player winnings pool to the eligible player or players by crediting the deposit/winnings account of each winning player (step 618). The identification of the winners of the game and the distribution of the player winnings pool is performed in real-time. When the player has finished playing the game, he or she may continue to play in subsequent games or he or she may exit the game by using the appropriate button or touch-screen command on the player terminal 100 to eject the personal identification card (step 620). The player may then return to a cashier's cage or remote cashier's terminal. The account server 400 continuously records and reports the amount remaining in the player's deposit/winnings account in real-time and, after proper identification has been presented to the cashier's terminal 410, the player can redeem the balance of his or her funds (step 622).

In addition to the networked configuration described above, it is also possible to run the cashless video game system in an Internet environment. In such an environment, similar to the system described above, the player goes to a website and sets up an account with identification and verification information, as well as available funds for wagers. The player account information can be stored on the web server supporting the website. To play a game, a page at the website displays the games offered, and the player selects which game to play. At a regular interval, the selected game is played among all of the players committed to enter the selected game, and the wagers of each player are collected and placed in the player winnings pool, after the appropriate takeout has been subtracted from the gross wagers pool. At the end of each game, the winners are determined, and the accounts of the determined winners are credited with the winnings from the player winnings pool.

The following description provides more detailed explanations of particular inter-player games using a pari-mutuel format. Each of these games, as described above, progress at regular, pre-established time sequences, regardless of whether or not any player wagers are made. Since the games operate continuously, players do not activate a game from any one of the player terminals 100. Further, in each game, participating players compete with one another for winnings and the gaming operator has no stake in the outcome of a particular game.

For Pari-Mutuel 5-Card Draw Poker, the video display 212 of each player terminal 100 displays five playing cards, with each card in a facedown position. The video display 212 also contains a separate display showing the wager amount, the player's combined deposit/winnings account, and the number of seconds before the next game begins. A player determines his or her wager amount, and presses a button or a touch-screen command on the display 212 to indicate when he or she is ready to enter the next game offered.

At regularly scheduled intervals, the game server 102 randomly generates five playing cards, which are displayed on the video display 212, with each card in a face-up position. The player now has a fixed period of time to hold or discard any or all of these five cards. After the player has made his or her hold/discard selections, the game server 102 replaces the cards that are discarded. If the player does not complete his or her selections within the allotted time period, all cards which have been affirmatively discarded will be replaced automatically; all other cards will be deemed to be held by the player.

After the draw has occurred, the five cards in the player's hand will be evaluated against the hands on other player terminals 100 entered in the same game. Each winning hand is appropriately highlighted or displayed on a player's terminal. Depending on the rules for the game, the player winnings pool may be distributed to the best hand among the players entered in the game, or to multiple winners in each game, using a pari-mutuel format.

For Pari-Mutuel 7-Card Stud Poker, the video display 212 of each player terminal 100 displays seven playing cards, with each card in a facedown position. The video display 212 also contains a separate display showing the wager amount, the player's combined deposit/winnings account, and the number of seconds before the next game begins. A player determines his or her wager amount, and presses a button or a touch-screen command on the video display 212 to indicate when he or she is ready to enter the next game offered.

At regularly scheduled intervals, the game server 102 randomly generates seven playing cards, which are displayed on the video display 212, with each card in a face-up position. The player now has a fixed period of time to indicate which five cards (of the seven cards displayed) he or she wants to hold. The two remaining cards are discarded. If the player does not complete his or her selections within the allotted time period, the five cards with the highest value are automatically selected; the two remaining cards are discarded.

After this process has been completed, the five cards in each player's hand are evaluated against the hands on other player terminals 100 entered in the same game. Depending on the rules for each game, the player winnings pool may be distributed to the best hand among the players entered in the game, or to multiple winners in each game, using a pari-mutuel format. Each winning hand is appropriately highlighted or displayed on a player's terminal 100.

For Pari-Mutuel Texas Hold 'Em Poker, the video display 212 of each player terminal 100 displays seven playing cards, with each card in a facedown position. The video display 212 also contains a separate display showing the wager amount, the player's combined deposit/winnings account, and the number of seconds before the next game begins. A player determines his or her wager amount, and presses a button or a touch-screen command on the video display 212 to indicate when he or she is ready to enter the next game offered.

At regularly scheduled intervals, the game server 102 randomly generates seven playing cards, which are displayed on the video display 212, with each card in a face-up position. Two of the cards are the player's private cards; the other five cards are considered community cards. The five community cards are displayed on all player terminals 100 enrolled in the current game; these cards are identical for all players competing against each other in the same game. The player now has a fixed period of time to indicate which five cards (of the two private cards and the five community cards displayed) he or she wants to hold, to make the best hand. The two remaining cards are discarded. If the player does not complete his or her selections within the allotted time period, the five cards with the highest value are automatically selected; the two remaining cards are discarded.

After this process has been completed, the five cards in each player's hand are evaluated against the hands on other player terminals entered in the same game. Depending on the rules for each game, the player winnings pool may be distributed to the best hand among the players entered in the game, or to multiple winners in each game, using a pari-mutuel format. Each winning hand is appropriately highlighted or displayed on a player's terminal 100.

For Pari-Mutuel Omaha Hold 'Em Poker, the video display 212 of each player terminal 100 displays nine playing cards, with each card in a facedown position. The video monitor also contains a separate display showing the wager amount, the player's combined deposit/winnings account, and the number of seconds before the next game begins. A player determines his or her wager amount, and presses a button or a touch-screen command on the video display 212 to indicate when he or she is ready to enter the next game offered.

At regularly scheduled intervals, the game server 102 randomly generates nine playing cards, which are displayed on the video display, with each card in a face-up position. Four of the cards are the player's private cards; the other five cards are considered community cards. The five community cards are displayed on all player terminals 100 enrolled in the current game; these cards are identical for all players competing against each other in the same game. The player now has a fixed period of time to indicate which five cards (of the four private cards and the five community cards displayed) he or she wants to hold. The player must select two of the four private cards and then selects any three cards from the community cards to make a best hand of five cards. The four remaining private and community cards are discarded. If the player does not complete his or her selections within the allotted time period, the two private cards and the three community cards with the highest value are automatically selected; the four remaining cards are discarded.

After this process has been completed, the five cards in each player's hand are evaluated against the hands on other player terminals entered in the same game. Depending on the rules for each game, the player winnings pool may be distributed to the best hand among the players entered in the game, or to multiple winners in each game, using a pari-mutuel format. Each winning hand is appropriately highlighted or displayed on a player's terminal 100.

For Pari-Mutuel Pai Gow Poker, the video display 212 of each player terminal 100 displays seven playing cards, with each card in a facedown position. The video display 212 also contains a separate display showing the wager amount, the player's combined deposit/winnings account, and the number of seconds before the next game begins. A player determines his or her wager amount, and presses a button or a touch-screen command on the display to indicate when he or she is ready to enter the next game offered.

At regularly scheduled intervals, the game server 102 randomly generates seven playing cards, which are displayed on the video monitor, with each card in a face-up position. The player now has a fixed period of time to "set" his or her hands by arranging the cards into a high hand with five cards and a low hand with two cards. When setting the two hands, the five card high hand shall be equal to or higher in rank than the two card low hand. For example, if the two card low hand contains a pair of four's, then the five card high hand shall contains at least a pair of four's in the ranking of the cards, under traditional pai gow poker rules. If the player does not complete his or her selections within the allotted time period, the high and low hands are automatically selected in a manner which provides the player with the highest ranking under the rules of the game.

After this process has been completed, the high and low hands for each player are evaluated against the high and low hands for other player terminals entered in the same game. Depending on the rules for each game, the player winnings pool may be distributed to the best high and low hand among the players entered in the game, or to multiple winners in each game, using a pari-mutuel format. Each winning high and low hand is appropriately highlighted or displayed on a player's terminal 100.

For Pari-Mutuel Bingo, the video display 212 of each player terminal 100 displays one or more bingo cards, each displaying a pre-determined set of numbers. The video display 212 also contains a separate display showing the wager amount, the player's combined deposit/winnings account, and the number of seconds before the next game begins. A player selects the bingo card (or cards) which he or she wants to play, determines his or her wager amount, and presses a button or a touch-screen command on the video display 212 to indicate when he or she is ready to enter the next game offered.

At regularly scheduled intervals, the game server 102 randomly generates a pre-determined amount of numbers from an infinite or finite pool of numbers. The numbers chosen by the game server 102 are simultaneously displayed on the player's video monitor. Numbers matching or covering the player's numbers on each selected bingo card are highlighted on each player's terminal 100.

After this process has been completed, the bingo card or cards displayed on each player's terminal 100 will be evaluated against the bingo cards displayed on other player terminals 100 entered in the same game. Depending on the rules for each game, the player winnings pool may be distributed to the best bingo card among the players entered in the game, or to multiple winners in each game, using a pari-mutuel format. Each winning bingo card is appropriately highlighted or displayed on a player's terminal 100.

For Pari-Mutuel Keno, the video display 212 of each player terminal 100 displays a matrix, grid, or box with up to 80 numbers. The video display 212 also contains a separate display showing the wager amount, the player's combined deposit/winnings account, and the number of seconds before the next game begins. A player selects up to 20 numbers, determines his or her wager amount, and presses a button or a touch-screen command on the video display 212 to indicate when he or she is ready to enter the next game offered. A player also may have his or her numbers randomly selected at each player terminal 100 through the initiation of a "Quick Pick" function.

At regularly scheduled intervals, the game server 102 randomly generates up to 20 numbers from a pool of 80 numbers. The numbers chosen by the game server 102 are simultaneously displayed on the matrix, grid, or box on each player's video display 212. Numbers matching a player's selected or "Quick Pick" numbers are highlighted on the matrix, grid, or box on each player's terminal 100.

After this process has been completed, the number of successful numeric matches displayed on each player's terminal 100 will be evaluated against the number of successful numeric matches displayed on other player terminals 100 entered in the same game. Depending on the rules for each game, the player winnings pool may be distributed to the largest number of numeric matches among the players entered in the game, or to multiple winners in each game, using a pari-mutuel format. Each winning matrix, grid, or box is appropriately highlighted or displayed on a player's terminal 100.

For Pari-Mutuel Lotto, the video display 212 of each player terminal 100 displays one or more matrices, grids, boxes, or tickets displaying a pre-determined set of numbers. The video display also contains a separate display showing the wager amount, the player's combined deposit/winnings account, and the number of seconds before the next game begins. A player selects a pre-determined amount of numbers, determines his or her wager amount, and presses a button or a touch-screen command on the video display 212 to indicate when he or she is ready to enter the next game offered. A player also may have his or her numbers randomly selected at each player terminal 100 through the initiation of a "Quick Pick" function.

At regularly scheduled intervals, the game server 102 randomly generates a pre-determined amount of numbers from an infinite or finite pool of numbers. The numbers chosen by the game server 102 are simultaneously displayed on the matrix, grid, box, or ticket on the video monitor of each player's terminal. Numbers matching a player's selected or "Quick Pick" numbers are highlighted on the matrix, grid, box, or ticket on each player's terminal 100.

After this process has been completed, the number of successful numeric matches displayed on each player's terminal 100 will be evaluated against the number of successful numeric matches displayed on other player terminals 100 entered in the same game. Depending on the rules for each game, the player winnings pool may be distributed to the largest number of numeric matches among the players entered in the game, or to multiple winners in each game, using a pari-mutuel format. Each winning matrix, grid, box, or ticket is appropriately highlighted or displayed on a player's terminal 100.

For Pari-Mutuel Pull-Tabs, the video display 212 of each player terminal 100 displays one or more covered pull-tab cards. The video display 212 also contains a separate display showing the wager amount, the player's combined deposit/winnings account, and the number of seconds before the next game begins. A player selects the pull-tab card or cards which he or she wants to play, determines his or her wager amount, and presses a button or a touch-screen command on the video display 212 to indicate when he or she is ready to enter the next game offered.

At regularly scheduled intervals, the game server 102 randomly generates a pre-determined amount of numbers, symbols, or colors from an infinite or finite pool of numbers, symbols, or colors. The numbers, symbols, or colors chosen by the game server 102 are simultaneously viewed as an uncovered pull-tab card and displayed as combinations of fruit, bars, bells, jewels, animals, flags, stars, sevens, or other symbols or colors on the video display 212 of each player's terminal 100.

After this process has been completed, the pull-tab card or cards displayed on each player's terminal 100 will be evaluated against the pull-tab cards displayed on other player terminals 100 entered in the same game. Depending on the rules for each game, the player winnings pool may be distributed to the best pull-tab card among the players entered in the game, or to multiple winners in each game, using a pari-mutuel format. Each winning pull-tab card is appropriately highlighted or displayed on a player's terminal 100.

For Pari-Mutuel Single- or Multi-Line, the video display 212 of each player terminal 100 contains a matrix or box with 3, 6, or 9 numbers, symbols, or colors. The video display 212 also contains a separate display showing the wager amount, the player's combined deposit/winnings account, and the number of seconds before the next game begins. A player selects a pre-determined amount of numbers, symbols, or colors, determines his or her wager amount, and presses a button or a touch-screen command on the video display 212 to indicate when he or she is ready to enter the next game offered. A player also may increase his or her wager by selecting up to 3 horizontal, 3 vertical, and 2 diagonal lines of 3 numbers, symbols, or colors each and wagering 1 unit for each combination chosen or for the entire field of play.

At regularly scheduled intervals, the game server 102 randomly generates 3, 6, or 9 numbers, symbols, or colors from an infinite or finite pool of numbers, symbols, or colors. The numbers, symbols, or colors chosen by the game server 102 are simultaneously displayed as fruit, bars, bells, jewels, animals, flags, stars, sevens, or other symbols or colors on the video monitor of each player's terminal 100.

After this process has been completed, the combinations of numbers, symbols, or colors displayed on each player's terminal 100 will be evaluated against the combinations of numbers, symbols, or colors displayed on other player terminals 100 entered in the same game. Depending on the rules for each game, the player winnings pool may be distributed to the best combination of numbers, symbols, or colors among the players entered in the game, or to multiple winners in each game, using a pari-mutuel format. Each winning combination of numbers, symbols, or colors is appropriately highlighted or displayed on a player's terminal 100.

For Pari-Mutuel Blackjack, the video display 212 of each player terminal 100 displays two playing cards, with each card in a facedown position. The video display 212 also contains a separate display showing the wager amount, the player's combined deposit/winnings account, and the number of seconds before the next game begins. A player determines his or her wager amount, and presses a button or a touch-screen command on the video display 212 to indicate when he or she is ready to enter the next game offered.

At regularly scheduled intervals, the game server 102 randomly generates two playing cards, which are displayed on the video monitor, with each card in a face-up position. The player now has a fixed period of time to indicate whether he or she wants an additional card or cards to improve his or her total count under regular blackjack rules. Under certain circumstances, the game rules also may permit the player to "double down," "split," "surrender," or otherwise increase or change his or her wager amount. After the player has made his or her requests involving additional cards and/or wagers, the game server 102 provides randomly generated cards until the player's total count exceeds 21 or the player decides to "stand." If the player does not complete his or her requests within the allotted time period, additional cards are not provided, and the total count of the cards which are remaining is the player's final count for the game.

After this process has been completed, the total count and the cards in each player's hand will be evaluated against the total count and the cards on other player terminals 100 entered in the same game. Depending on the rules for each game, the player winnings pool may be distributed to the best hand or hands among the players entered in the game, with tied winning hands sharing the pool equally. Alternatively, the game rules can provide for multiple winners in each game, using a pari-mutuel format. Each winning hand is appropriately highlighted or displayed on a player's terminal 100.

This description describes the presently preferred embodiments and methods of the present invention, but those skilled in the art would recognize that various changes and modifications may be made, and equivalents may be substituted without departing from the scope of the invention.

For example, the figures and description include a game server as a separate device for generating random numbers for the player terminals associated with that game server. Each player terminal could also maintain its own random number generator. In this embodiment, the random number generators in each player terminal would preferably be synchronized to provide a random number at a predetermined interval, just as described above for the separated random number generator in a game server. A random number generator could also be provided in the central control network 104 rather than in a separate game server. As a further example, the central control network may maintain its own game server.

In addition, many modifications may be made to adapt a particular element, technique or implementation to the teachings of the present invention without departing from the scope of the invention. Therefore, this invention should not be limited to the particular embodiments and methods disclosed herein, but that the invention include all embodiments falling within the scope of the appended claims.

The foregoing description of a preferred embodiment of the invention has been presented for purposes of illustration and description. It is not intended to be exhaustive or to limit the invention to the precise form disclosed, and modifications and variations are possible in light in the above teachings or may be acquired from practice of the invention. The embodiment was chosen and described in order to explain the principles of the invention and as practical application to enable one skilled in the art to utilize the invention in various embodiments and with various modifications are suited to the particular use contemplated. It is intended that the scope of the invention be defined by the claims appended hereto and their equivalents.

What is claimed is:

1. A method of operating one or more games of chance for a plurality of players with one or more computers, comprising:

identifying at least two players participating in a selected one of the games of chance at the expiration of a predetermined time period at the beginning of every game of chance;

establishing at the one or more computers a wager pool for each selected game of chance, the wager pool including a total of wager amounts from each of the identified players at one or more locations;

reducing the wager pool by a takeout amount that corresponds to a predetermined percentage or amount of the wager pool;

generating one or more random numbers;

determining one or more winners of the selected game of chance based on the one or more random numbers;

calculating the amount of winnings for the determined one or more winners using a non-fixed odds payout amount in which players compete with one another in the selected game of chance for winnings; and distributing, at the end of each game of chance, the funds from the wager pool for each wager type to the determined one or more winners of the selected game of chance, wherein a portion of a player's wager is not deducted as a takeout amount at a player terminal but instead is deducted when the player's wager is combined with wager amounts from other players to establish the wager pool, wherein the games of chance operate continuously in pre-established time sequences, wherein players cannot alter a start time of the offered games of chance from any player terminal, and wherein a monetary value that corresponds to the funds of the wager pool that are distributed at the end of each game of chance to the one or more winners does not change in monetary value based on winnings made in previous and future games of chance participated in by one or more of the plurality of players.

2. A method according to claim 1, wherein the distributing includes allocating funds from the wager pool in accordance with a non-fixed odds payout schedule.

3. A method according to claim 1, wherein the distributing includes allocating funds from the wager pool based on a pari-mutuel format in proportion to the wager amount of each determined winner.

4. A method according to claim 1, further comprising:

storing account information for each player, the account information including an amount of available funds for each player; and crediting the amount of available funds in the account information of each player determined to be a winner of the selected game of chance.

5. A method according to claim 4, wherein the account information for each player further includes player identification information and identification verification information, and wherein the identifying includes:

receiving player identification information and identification verification information from a player;

identifying the account information for the player from the received player identification information; and verifying that the player can participate in the selected game of chance based on the identified account information of the player and the received identification verification information, wherein no paper currency, coins, debit cards or credit cards are input to the one or more computers in order to allow the at least two players to participate in the selected game of chance.

6. A method according to claim 4, further comprising deducting by the one or more computers that do not correspond to terminals on which the at least two players are participating in the selected game of chance, the amount of available funds in the account information of each of the identified players by the wager amount of each respective player.

7. A method according to claim 6, wherein the deduction is made prior to the game of chance being played.

8. A method according to claim 1, further comprising:

displaying a list of each of the one or more games of chance in which a player may participate; and receiving a selection of which game of chance a particular player desires to play.

9. A method according to claim 8, wherein the displayed list of games of chance includes at least one of poker, keno, bingo, pulltabs, lotto, blackjack, pari-mutuel single-line numbers, symbols or colors, or pari-mutuel multi-line numbers, symbols or colors.

10. A method according to claim 1, wherein a player is dependent on the participation of other players in the same game of chance for the purpose of determining the amount of winnings a player receives if determined to be a winner of the selected game of chance.

11. A method according to claim 1, further comprising converting the one or more random numbers into one or more numbers, colors, symbols or cards in accordance with the selected game of chance.

12. A method according to claim 1, wherein the wager pool does not receive losing player wagers after one or more winners of the selected game of chance are determined.

13. A method of operating, at a computer, one or more games of chance for a plurality of players, comprising:

selecting at the computer which one of the games of chance in which to participate at the expiration of a predetermined time period;

entering a wager amount, which is placed in a wager pool for each selected game of chance, the wager pool including a total of wager amounts from each player participating in the selected game of chance at one or more locations;

receiving one or more random numbers;

converting the one or more random numbers into one or more numbers, colors, symbols or cards in accordance with the selected game;

receiving an indication of whether the player has won the selected game of chance in which players compete with one another in the selected game of chance for winnings; and receiving at least a portion of the funds from the wager pool if the player is a winner of the selected game of chance, wherein the funds of the wager pool are distributed to winners of the selected game of chance for each wager type at the end of each game of chance, wherein a portion of a player's wager is not deducted as a takeout amount at a player terminal but instead is deducted when the player's wager is combined with wager amounts from other players to establish the wager pool, wherein the games of chance operate continuously in pre-established time sequences, wherein players cannot alter a start time of the offered games of chance from any player terminal, and wherein a monetary value that corresponds to the funds of the wager pool that are distributed at the end of each game of chance to the one or more winners does not change in monetary value based on winnings made in previous and future games of chance participated in by one or more of the plurality of players.

14. A method according to claim 13, wherein the amount of the funds received from the wager pool is determined in accordance with a non-fixed odds payout schedule.

15. A method according to claim 13, wherein the amount of the funds received from the wager pool is based on a pari-mutuel format in proportion to the wager amount of the player.

16. A method according to claim 13, further comprising:

submitting account information for the player, the account information including an amount of available funds for the player, wherein the amount of the funds received from the wager pool is credited to the amount of available funds in the account information of the player if the player is determined to be a winner of the selected game of chance.

17. A method according to claim 16, wherein the amount of available funds in the account information of the player is deducted, by the one or more computers that do not correspond to terminals on which the at least two players are participating in the selected game of chance, by the wager amount of the player.

18. A method according to claim 17, wherein the deduction is made prior to the game of chance being played.

19. A method according to claim 13, further comprising:

displaying a list of each of the one or more games of chance in which a player may participate.

20. A method according to claim 19, wherein the displayed list of games of chance includes at least one of poker, keno, bingo, pulltabs, lotto, blackjack, pari-mutuel single-line numbers, symbols or colors, or pari-mutuel multi-line numbers, symbols or colors.

21. A method according to claim 13, wherein the player is dependent on the participation of other players in the same game of chance for the purpose of determining the amount of the funds received from the wager pool if the player is a winner of the selected game of chance.

22. A method according to claim 13, further comprising converting the one or more random numbers into one or more numbers, colors, symbols or cards in accordance with the selected game of chance.

23. A method according to claim 13, wherein the wager pool does not receive losing player wagers after one or more winners of the selected game of chance are determined.

24. A game system for operating one or more games of chance for a plurality of players, the game system comprising:

a processor; and a memory, coupled to the processor, comprising a plurality of logic units, each logic unit including a plurality of instructions executed by the processor, the memory comprising:

accounting logic configured to identify at least two players participating in a selected one of the games of chance at the expiration of a predetermined time period at the beginning of every game of chance;

central processing logic configured to establish a wager pool for each selected game of chance, the wager pool including a total of wager amounts from each of the identified players at one or more locations, and reduce the wager pool by a takeout amount that corresponds to a predetermined percentage or amount of the wager pool; and game logic configured to generate one or more random numbers, wherein the accounting logic is further configured to determine one or more winners of the selected game of chance based on the one or more random numbers and to distribute at the end of each game of chance the funds from the wager pool for each wager type to the determined one or more winners of the selected game of chance in which players compete with one another in the selected game of chance for winnings, wherein a portion of a player's wager is not deducted as a takeout amount at a player terminal but instead is deducted when the player's wager is combined with wager amounts from other players to establish the wager pool, wherein the games of chance operate continuously in pre-established time sequences, wherein players cannot alter a start time of the offered games of chance from any player terminal, and wherein a monetary value that corresponds to the funds of the wager pool that are distributed at the end of each game of chance to the one or more winners does not change in monetary value based on winnings made in previous and future games of chance participated in by one or more of the plurality of players.

25. A game system according to claim 24, wherein the accounting logic is further configured to allocate funds from the wager pool in accordance with a non-fixed odds payout schedule.

26. A game system according to claim 24, wherein the accounting logic is further configured to allocate funds from the wager pool based on a pari-mutuel format in proportion to the wager amount of each determined winner.

27. A game system according to claim 24, wherein the accounting logic is further configured to store account information for each player, the account information including an amount of available funds for each player, and to credit the amount of available funds in the account information of each player determined to be a winner of the selected game of chance.

28. A game system according to claim 27, wherein the account information for each player further includes player identification information and identification verification information, and wherein the accounting logic is further configured to receive player identification information and identification verification information from a player, to identify the account information for the player from the received player identification information, and to verify that the player can participate in the selected game of chance based on the identified account information of the player and the received identification verification information, wherein no paper currency, coins, debit cards or credit cards are input to the one or more computers in order to allow the at least two players to participate in the selected game of chance.

29. A game system according to claim 28, wherein the accounting logic is further configured to deduct the amount of available funds in the account information of each of the identified players by the wager amount of each respective player.

30. A game system according to claim 29, wherein the deduction is made prior to the game of chance being played.

31. A game system according to claim 24, wherein the displayed list of games of chance includes at least one of poker, keno, bingo, pulltabs, lotto, and blackjack, pari-mutuel single-line numbers, symbols or colors, or pari-mutuel multi-line numbers, symbols or colors.

32. A game system according to claim 24, wherein a player is dependent on the participation of other players in the same game of chance for the purpose of determining the amount of winnings a player receives if determined to be a winner of the selected game of chance.

33. A game system according to claim 24, wherein the game logic is further configured to convert the one or more random numbers into one or more numbers, colors, symbols or cards in accordance with the selected game of chance.

34. A game system according to claim 24, wherein the wager pool does not receive losing player wagers after one or more winners of the selected game of chance are determined.

35. A player terminal for playing one or more games of chance with a plurality of players, comprising:

a processor; and a memory, coupled to the processor, comprising a plurality of instructions executed by the processor, the plurality of instructions configured to:

select which one of the games of chance in which to participate at the expiration of a predetermined time period;

enter a wager amount, which is placed in a wager pool for each selected game of chance, the wager pool including a total of wager amounts from each player participating in the selected game of chance at one or more locations;

receive one or more random numbers;

convert the one or more random numbers into one or more numbers, colors, symbols or cards in accordance with the selected game of chance;

receive an indication of whether the player has won the selected game of chance in which players compete with one another in the selected game of chance for winnings; and receive at least a portion of the funds from the wager pool if the player is a winner of the selected game of chance, wherein the funds of the wager pool for each wager type are distributed to winners of the selected game of chance at the end of each game of chance, wherein a portion of a player's wager is not deducted as a takeout amount at a player terminal but instead is deducted when the player's wager is combined with wager amounts from other players to establish the wager pool, wherein the games of chance operate continuously in pre-established time sequences, wherein players cannot alter a start time of the offered games of chance from any player terminal, and wherein a monetary value that corresponds to the funds of the wager pool that are distributed at the end of each game of chance to the one or more winners does not change in monetary value based on winnings made in previous and future games of chance participated in by one or more of the plurality of players.

36. A player terminal according to claim 35, wherein the amount of the funds received from the wager pool is determined in accordance with a non-fixed odds payout schedule.

37. A player terminal according to claim 35, wherein the amount of the funds received from the wager pool is based on a pari-mutuel format in proportion to the wager amount of the player.

38. A player terminal according to claim 35, the memory further comprising instructions configured to:

submit account information for the player, the account information including an amount of available funds for the player, wherein the amount of the funds received from the wager pool is credited to the amount of available funds in the account information of the player if the player is determined to be a winner of the selected game of chance.

39. A player terminal according to claim 38, wherein the amount of available funds in the account information of the player is deducted, by the one or more computers that do not correspond to terminals on which the at least two players are participating in the selected game, by the wager amount of the player.

40. A player terminal according to claim 39, wherein the deduction is made prior to the game of chance being played.

41. A player terminal according to claim 35, the memory further comprising an instruction configured to:

display a list of each of the one or more games of chance in which a player may participate.

42. A player terminal according to claim 41, wherein the displayed list of games of chance includes at least one of poker, keno, bingo, pulltabs, lotto, blackjack, pari-mutuel single-line numbers, symbols or colors, or pari-mutuel multi-line numbers, symbols or colors.

43. A player terminal according to claim 35, wherein the player is dependent on the participation of other players in the same game of chance for the purpose of determining the amount of the funds received from the wager pool if the player is a winner of the selected game of chance.

44. A player terminal according to claim 35, wherein the wager pool does not receive losing player wagers after one or more winners of the selected game of chance are determined.

* * * * *